US006817355B1

(12) United States Patent
Hawkins et al.

(10) Patent No.: US 6,817,355 B1
(45) Date of Patent: Nov. 16, 2004

(54) GAS BURNER MOUNTING ASSEMBLY FOR A COOKING APPLIANCE HAVING A CERAMIC-BASED COOKTOP

(75) Inventors: Dustin L. Hawkins, Cleveland, TN (US); Michael J. Shaver, Cleveland, TN (US); Jeffrey Ware, Chattanooga, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/460,263

(22) Filed: Jun. 13, 2003

(51) Int. Cl.[7] ..... F24C 15/10

(52) U.S. Cl. ..... 126/214 A; 126/39 R; 126/39 B; 126/39 E

(58) Field of Search ..... 126/214 R, 214 A, 126/39 R, 39 E, 39 H, 39 B, 40, 50

(56) References Cited

U.S. PATENT DOCUMENTS 5,313,929 A 5/1994 Thurk et al.
5,816,235 A 10/1998 Kim et al.
5,961,311 A * 10/1999 Moore, Jr. ..... 431/6
6,032,662 A 3/2000 Taplan et al.
6,050,176 A 4/2000 Schultheis et al.
6,120,282 A 9/2000 Vilato et al.
6,170,479 B1 1/2001 Taplan
6,173,708 B1 1/2001 Arntz et al.
6,209,534 B1 4/2001 Taplan
6,299,436 B1 10/2001 Huang

* cited by examiner

*Primary Examiner*—Jiping Lu
(74) *Attorney, Agent, or Firm*—Diederiks & Whitelaw, PLC

(57) ABSTRACT

A cooking appliance includes a cooktop having a support frame, a ceramic-based mounted to the support frame, a gas orifice holder arranged below the support frame having a frusto-conical projection that extends through an opening in the cooktop, and a base member. The base member includes a frusto-conical receiving member that is designed to matingly engage with the frusto-conical projection to form a gas burner assembly. The frusto-conical projection centers the gas burner assembly within the cooktop opening thereby alleviating the need to provide a gasket or seal between the gas burner assembly and an upper surface of the cooktop.

19 Claims, 5 Drawing Sheets

GAS BURNER MOUNTING ASSEMBLY FOR A COOKING APPLIANCE HAVING A CERAMIC-BASED COOKTOP

BACKGROUND OF THE INVENTION

1. Field of the Invention

The present invention pertains to the art of cooking appliances and, more particularly, to mounting a gas burner assembly to a cooking appliance having a ceramic-based cooktop.

2. Discussion of the Prior Art

A conventional gas cooking appliance will typically incorporate a cooktop having a surface which is generally formed of coated metal or glass. The cooktop is provided with one or more openings for receiving a gas operated burner assembly. More specifically, a portion of the gas operated burner assembly projects from an area below the cooking surface through the opening in the cooktop. Typically, the gas operated burner assembly is rigidly secured to a chassis of the appliance and either fixedly or loosely secured to the cooktop surface. Whether a fixed or loose connection is employed, some type of sealing arrangement is typically provided between the cooking surface and the gas operated burner assembly in order to seal the opening and thus prevent liquids and other foreign material from falling into the area below the cooking surface.

Other known gas appliances incorporate ceramic based cooktops, i.e., "CERAN", glass-ceramic or tempered glass cooktops. Due to characteristic material limitations, interior portions of such ceramic based cooktops must be allowed to flex when the appliance is in operation. For at least this reason, either a loose connection, or no connection at all is provided between the gas operated burner and the ceramic based cooktop, while a rigid connection is employed between the gas burner and the appliance chassis. Typically, the gas burner is mounted on rails which extend below and parallel to the cooktop, or upon support structure that projects from the chassis. The burner is then mounted to the rails/support structure in a manner that results in a portion of the burner projecting through an opening in the cooktop. With either arrangement, since the gas burner assembly must still project through the cooktop, it is extremely difficult to adequately center the burner assembly within the opening or to provide an effective seal between the burner and the cooktop.

Although there have been several attempts made in the art to provide an arrangement wherein a gas burner is secured to a glass cooktop, there still exists a need in the art for a gas burner assembly for use in connection with a cooking appliance incorporating a ceramic or ceramic/glass based cooktop, wherein the burner is decoupled from the cooktop, yet effectively centered within the burner opening and securely connected without requiring a separate seal or gasket between the burner and the cooktop.

SUMMARY OF THE INVENTION

The present invention is directed to a gas burner mounting assembly in a cooking appliance including a ceramic-based cooktop, wherein a gas burner assembly includes upper and lower portions secured one to the other with the cooktop being sandwiched therebetween. With this arrangement, the gas burner assembly is centered within an opening in the cooktop without requiring a seal positioned between the gas burner and the cooktop. Moreover, the gas burner assembly is secured to the cooktop such that movement of the appliance or the burner will not cause damage the cooktop.

In accordance with one preferred form of the invention, the cooktop includes a frame member having a top surface, a bottom surface and a ceramic-based panel secured to the top surface of the frame member. An opening is provided in both the ceramic-based panel and the frame member for receiving the burner assembly. More specifically, the gas burner assembly is mounted to a plurality of mounting flanges that extend from the frame member into the opening. The gas burner assembly includes a gas orifice holder having a frusto-conical projection and a burner base having a corresponding frusto-conical receiver adapted to matingly engage with the frusto-conical projection. The burner base includes a peripheral support surface interconnected to the frusto-conical receiver through an intermediate section. An annular ring, including a plurality of flame discharge ports, projects upwardly from the support surface.

The gas orifice holder is positioned below the bottom surface of the frame member so that at least a portion of the frusto-conical projection extends through the opening in the cooktop. The burner base is engaged with the orifice holder through the frusto-conical receiver and secured thereto with a plurality of fasteners that extend through the mounting flanges. With this construction, the frusto-conical projection provides a centering function for the base member. Moreover, the interface between the orifice holder and the burner base alleviates the requirement for providing a seal between the burner assembly and an upper surface of the cooktop.

In accordance with another preferred embodiment of the present invention, the gas burner assembly includes a burner base, a gas orifice, a burner plate and a gasket. The burner plate is provided to position the gas orifice holder and burner base within an opening in the cooktop. In further accordance with the present embodiment, a gasket is provided between the burner plate and the cooktop. The gasket serves as a damper, absorbing a portion of a clamping force generated between the burner base, the gas orifice holder and the cooktop.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
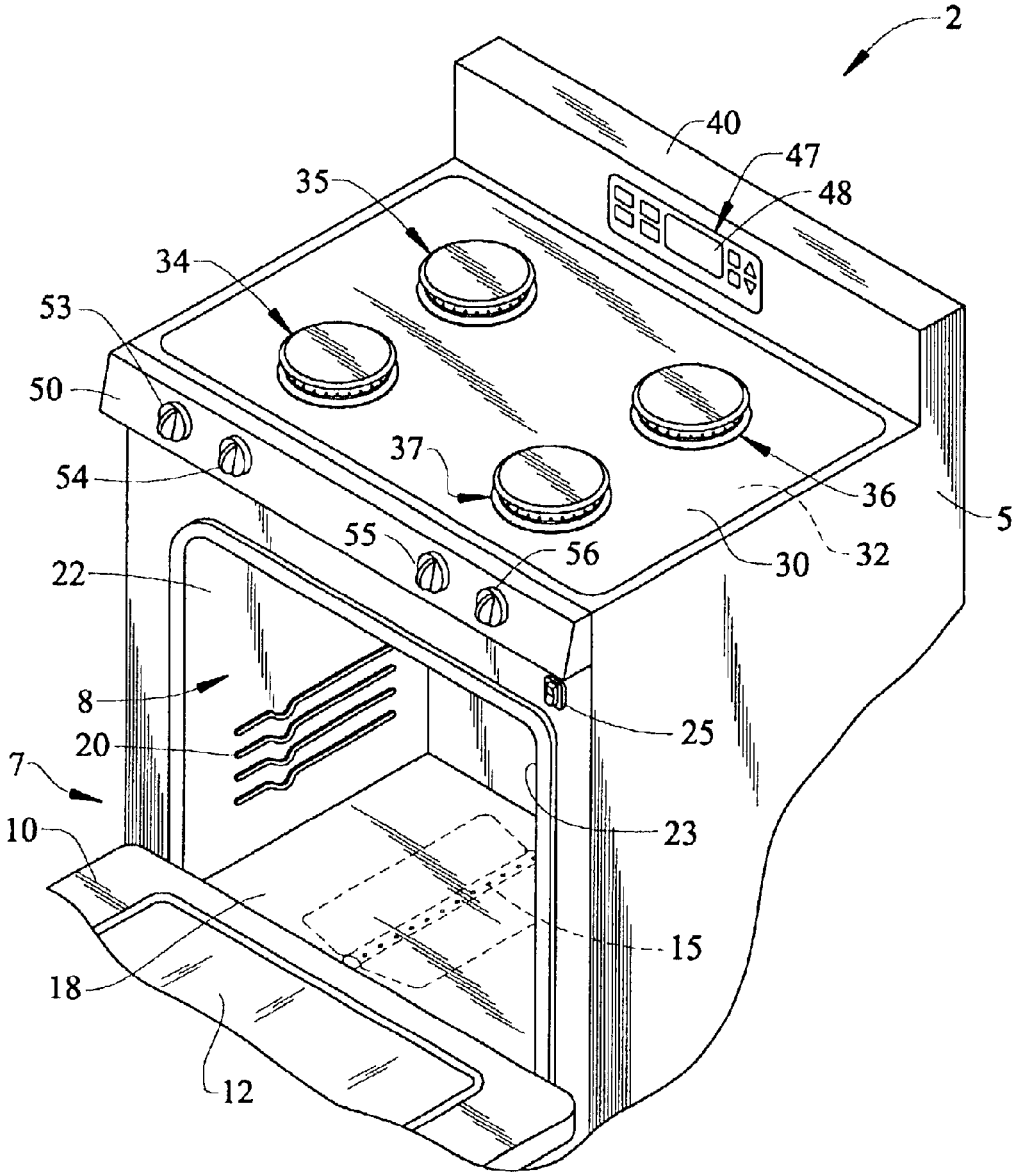
FIG. 1 is a partial upper right perspective view of a range incorporating the gas burner mounting assembly of the present invention.

With initial reference to FIG. 1, the present invention is incorporated into a cooking appliance 2 which is shown to represent a generic free-standing oven range. However, it should be realized that the present invention could also be used in connection with a slide-in range, as well as with an island-type cooktop. In any event, for exemplary purposes, cooking appliance 2 is shown to include a cabinet shell 5 within which is formed an oven 7 having an associated oven cavity 8. In a manner known in the art, oven 7 has associated therewith a door 10 which preferably includes a window 12 for viewing the contents of oven cavity 8 when door 10 is closed.

As cooking appliance 2 operates on gas, a gas burner 15 is provided beneath a bottom 18 of oven cavity 8. Furthermore, a plurality of fore-to-aft extending and vertically spaced shelf support rails 20 are provided on a side wall 22 of oven cavity 8. Of course, it should be understood that, while shelf support rails 20 are depicted on side panel 22, a corresponding plurality of shelf support rails (not shown) are arranged on an opposing side panel 23. For the sake of completeness, cooking appliance 2 is shown to be provided with a switch 25 that is adapted to be engaged by door 10 in order to deactivate a light (not shown) used to illuminate oven cavity 8 upon the opening of door 10. As should be readily apparent, the structure of cooking appliance 2 described to this point is widely known in the art and is simply provided for the sake of completeness.

In accordance with the invention, cooking appliance 2 incorporates a ceramic based-type cooktop 30. That is, cooktop 30 can take various forms and can be made from various ceramic or ceramic/glass based materials, for example, "CERAN". Preferably, cooktop 30 is mounted to cooking appliance 2 through a support frame 32. As will be discussed more fully below, a plurality of gas burner assemblies 34–37 are mounted to cooktop 30. Certainly, it should be understood that the plurality of gas burner assemblies 34–37 have associated therewith an overall burner grate arrangement that is not shown for the sake of simplicity. However, a preferred arrangement and mounting of the burner grate(s) is set forth in detail in commonly assigned U.S. patent application Ser. No. 10/323,644 entitled "Gas Grate Locating Assembly for a Ceramic-Based Cooktop" filed on Dec. 12, 2002 and hereby incorporated by reference.

Arranged in an upper rear portion of cooking appliance 2 is a control panel 40 which is preferably provided with a central control unit 47 that includes a visual display 48. Central control unit 47 is actually used to establish desired cooking operations for oven cavity 8 in a manner known in the art. Cooking appliance 2 further includes a front control surface 50 provided above oven cavity 8. Front control surface 50 has arranged thereon a plurality of control knobs 53–56 for controlling the operation of gas burner assemblies 34–37 respectively. Since the arrangement and operation of central control unit 47 and control knobs 53–56 do not form part of the present invention, they will not be discussed further here.

Figure 2:
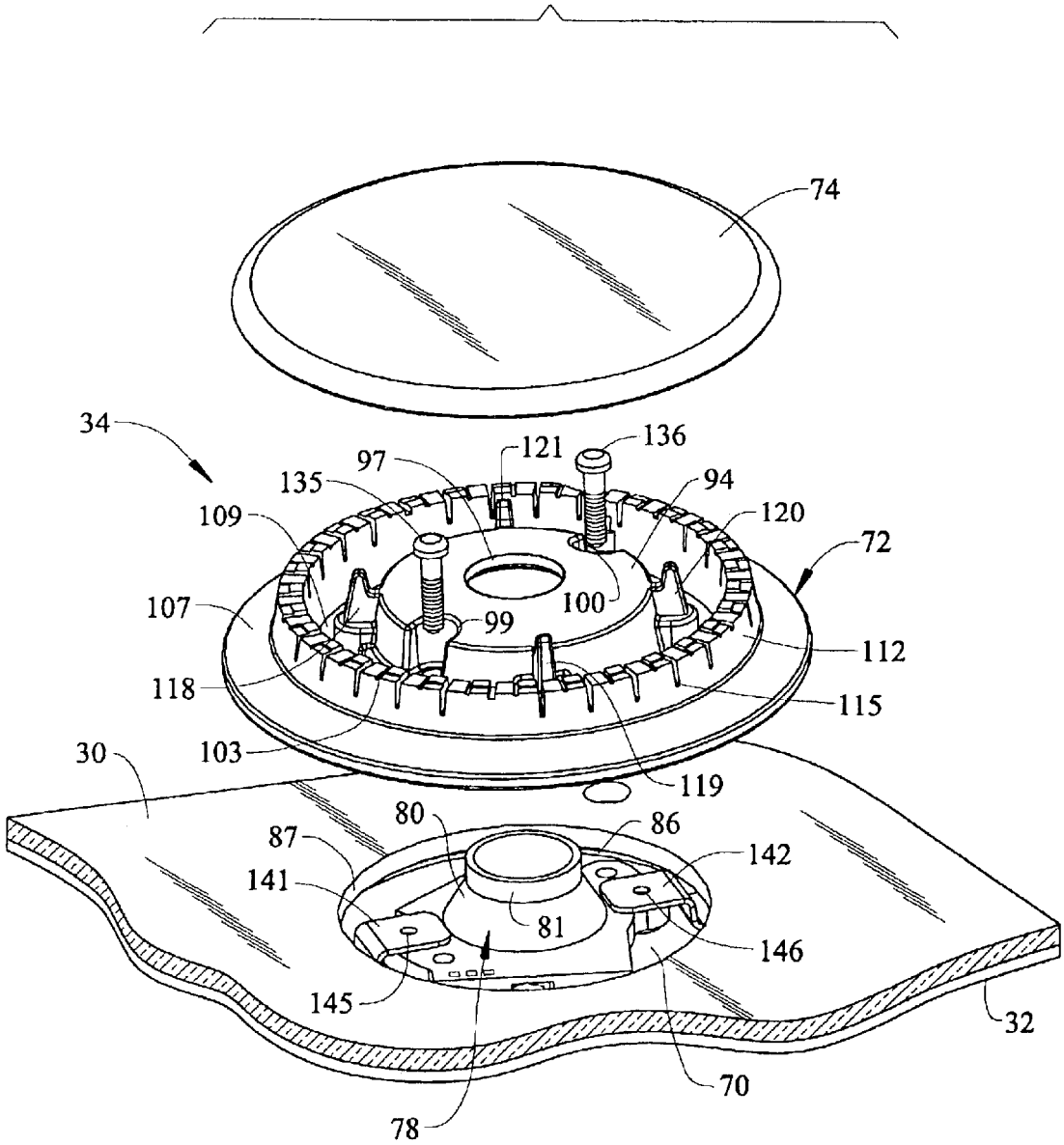
FIG. 2 is an exploded view of the gas burner mounting assembly of the invention.
Figure 3:
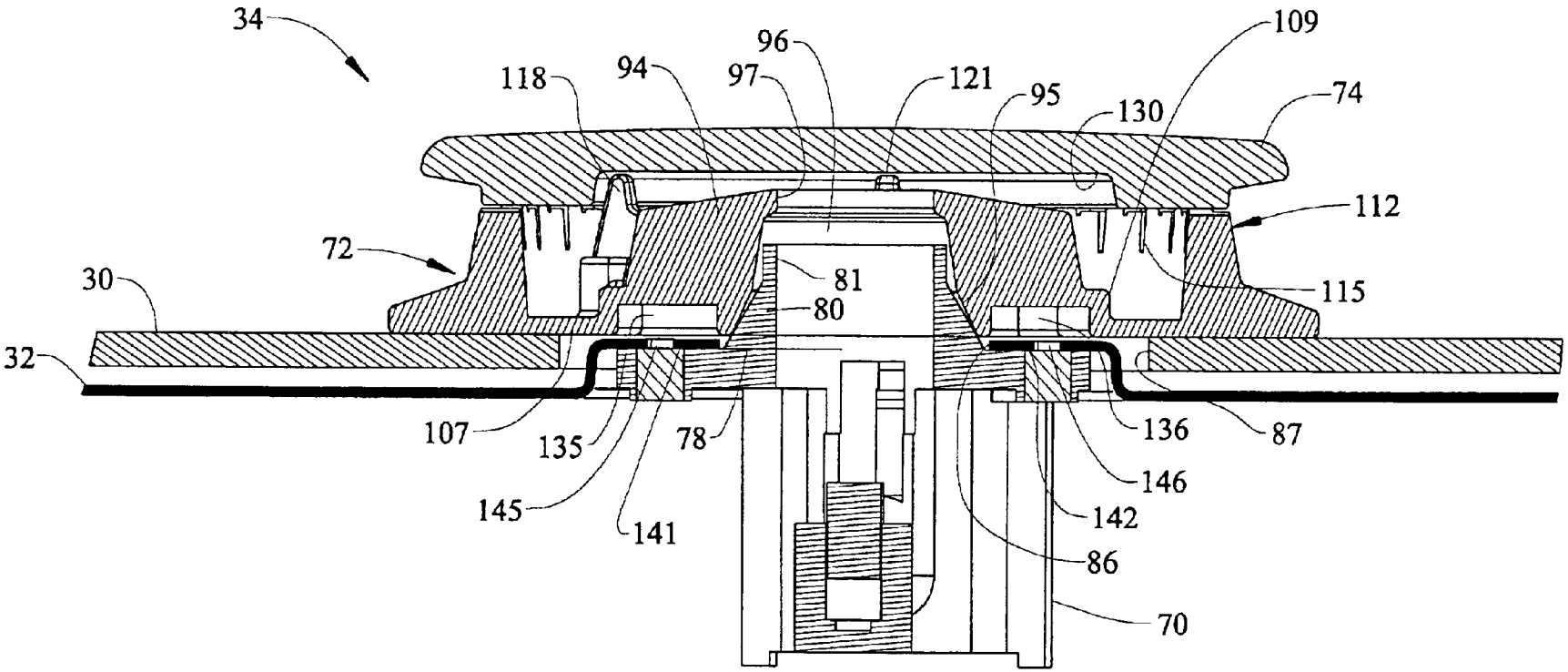
FIG. 3 is a cross-sectional side view of a portion of the gas burner mounting assembly shown in an assembled condition.

Reference will now be made to FIGS. 2 and 3 in describing the preferred structure and mounting of gas burner assembly 34 in accordance with one embodiment of the present invention and it is to be understood that gas burner assemblies 35–37 are correspondingly arranged. As shown, gas burner assembly 34 includes a gas orifice holder 70, a burner base member 72 and a burner cap 74. In accordance with a preferred form of the present invention, gas orifice holder 70 includes a frusto-conical projection 78 having a lower or tapered portion 80 leading to an upper annular ring segment 81. As will be discussed more fully below, frusto-conical projection 78 extends through a burner assembly opening 86 provided in support frame 32 as well as an opening 87 in cooktop 30.

As best seen in FIG. 3, burner base 72 includes a frusto-conical receiver 94 having a lower or tapered section 95 adapted to engage with tapered portion 80 of frusto-conical projection 78. More specifically, tapered section 95 extends to an inner collar 96 that leads to a central opening 97 (also see FIG. 2). In accordance with the embodiment illustrated, inner collar 96 is adapted to engage with annular ring segment 81 of frusto-conical projection 78. Frusto-conical receiver 94 further includes a pair of opposing notched segments 99 and 100 (FIG. 2), each having a respective lower opening 103. Certainly, the actual number and/or configuration of notched segments 99 and 100 could be varied.

Burner base 72 includes a peripheral support surface 107 for supporting burner base 72 upon cooktop 30. As shown, support surface 107 interconnects with frusto-conical receiver 94 through an intermediate section 109. Additionally, an upwardly projecting annular ring 112 extends substantially perpendicularly from the interface of peripheral support surface 107 and intermediate section 109. As shown, annular ring 112 includes a plurality of flame discharge ports, one of which is indicated at 115. Finally, a plurality of upstanding projections 118–121 extend from intermediate section 109 and, preferably, interconnect with frusto-conical receiver 94. As illustrated in FIG. 3, upstanding projections 118–121 provide support for burner cap 74. More specifically, burner cap 74 includes an inner recess 130 adapted to engage with upstanding projections 118–121 to provide for proper alignment of burner cap 74 on burner assembly 34. With this construction, burner cap 74 directs a gas through the plurality of gas discharge ports 115 to establish gas flames.

In order to secure gas burner assembly 34 to support frame 32, gas burner assembly 34 also includes a plurality of mechanical fasteners 135 and is 136. Mechanical fasteners 135 and 136 are preferably threaded into a pair of respective mounting apertures (not separately labeled) arranged within gas orifice holder 70. In accordance with the most preferred form of the invention, mechanical fasteners 135 and 136 extend through a pair of opposing locating flanges 141 and 142, each of which has a respective fastener receiving bore 145, 146. More specifically, locating flanges 141 and 142 extend from glass support frame 32 and project into burner assembly opening 86.

In this manner, gas orifice holder 70 is positioned below cooktop 30 with frusto-conical projection 78 extending through openings 86 and 87 in support frame 32 and cooktop 30 respectively. At this point, burner base 72 is attached to gas orifice holder 70 such that frusto-conical projection 80 frictionally mates with frusto-conical receiver 94. Once in place, burner base 72 is secured to gas orifice holder 70 with fasteners 135 and 136. With this arrangement, gas burner assembly 34 is mounted to appliance 2 with cooktop 30 being at once sandwiched between gas orifice holder 70 and burner base 72 while actually being only indirectly attached to cooktop 30.

With this construction, it should be readily apparent that gas burner assembly 34 is easily centered within burner assembly opening 86 on cooktop 30. In addition, as mechanical fasteners 135, 136 provide a clamping force between gas orifice holder 70 and burner base 72, there is no need to provide a gasket or other sealing element between peripheral support surface 107 and cooktop 30. As such, as best illustrated in FIG. 3, peripheral support surface 107 rests directly upon cooktop 30. In further accordance with the invention, as mechanical fasteners 135, 136 extend through locating flanges 141 and 142, gas burner assembly 35 will flex with cooktop 30 during operation of cooking appliance 2 due to the inherent flexure characteristics of locating flanges 141 and 142 of support frame 32. Therefore, cooktop 30 will not be subjected to stresses which may result in fractures which could ultimately cause cooktop 30 to break and the need for a gasket or other element is avoided while still maintaining intimate contact between gas burner assembly 34 and cooktop 30.

Figure 4:
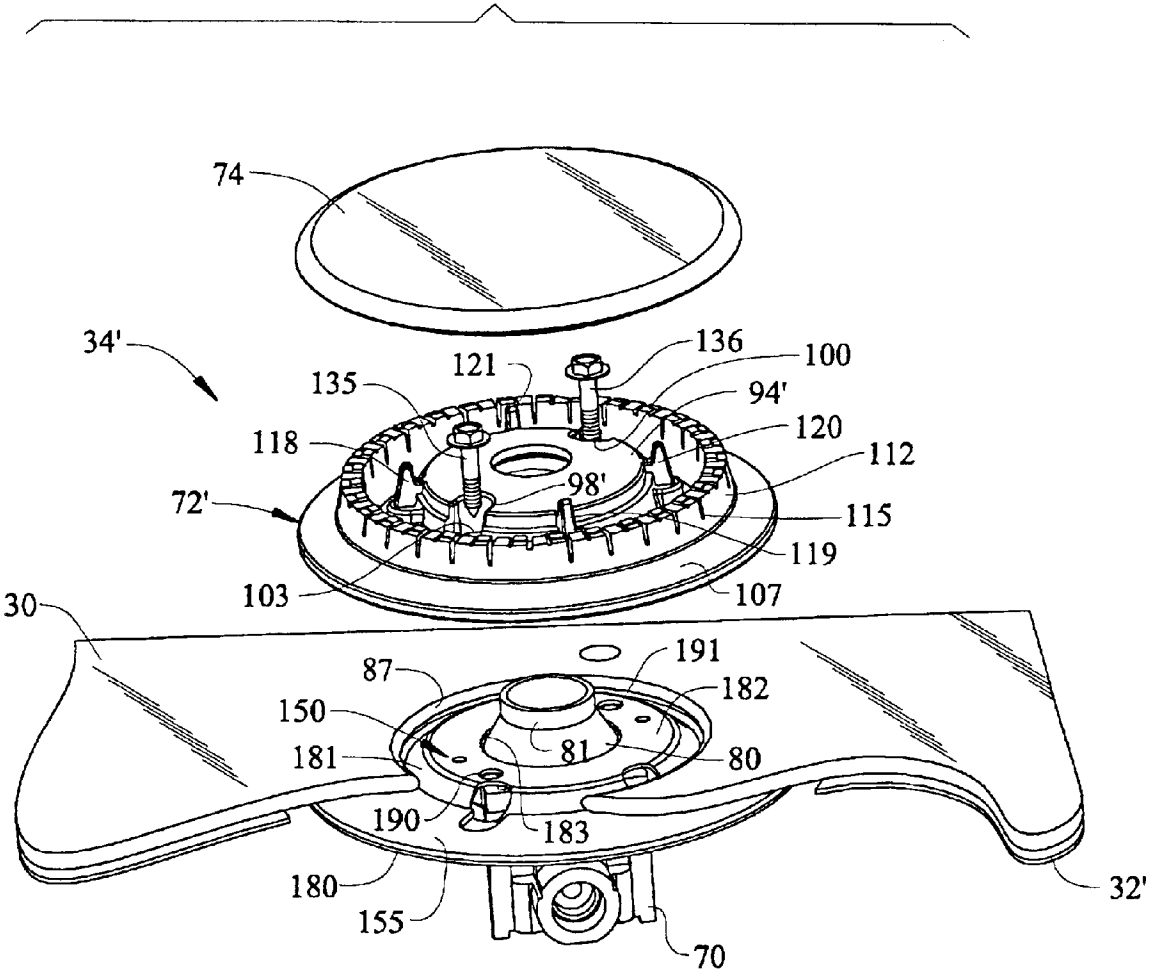
FIG. 4 is an exploded view of the gas burner mounting assembly constructed in accordance with a second embodiment of the present invention.
Figure 5:
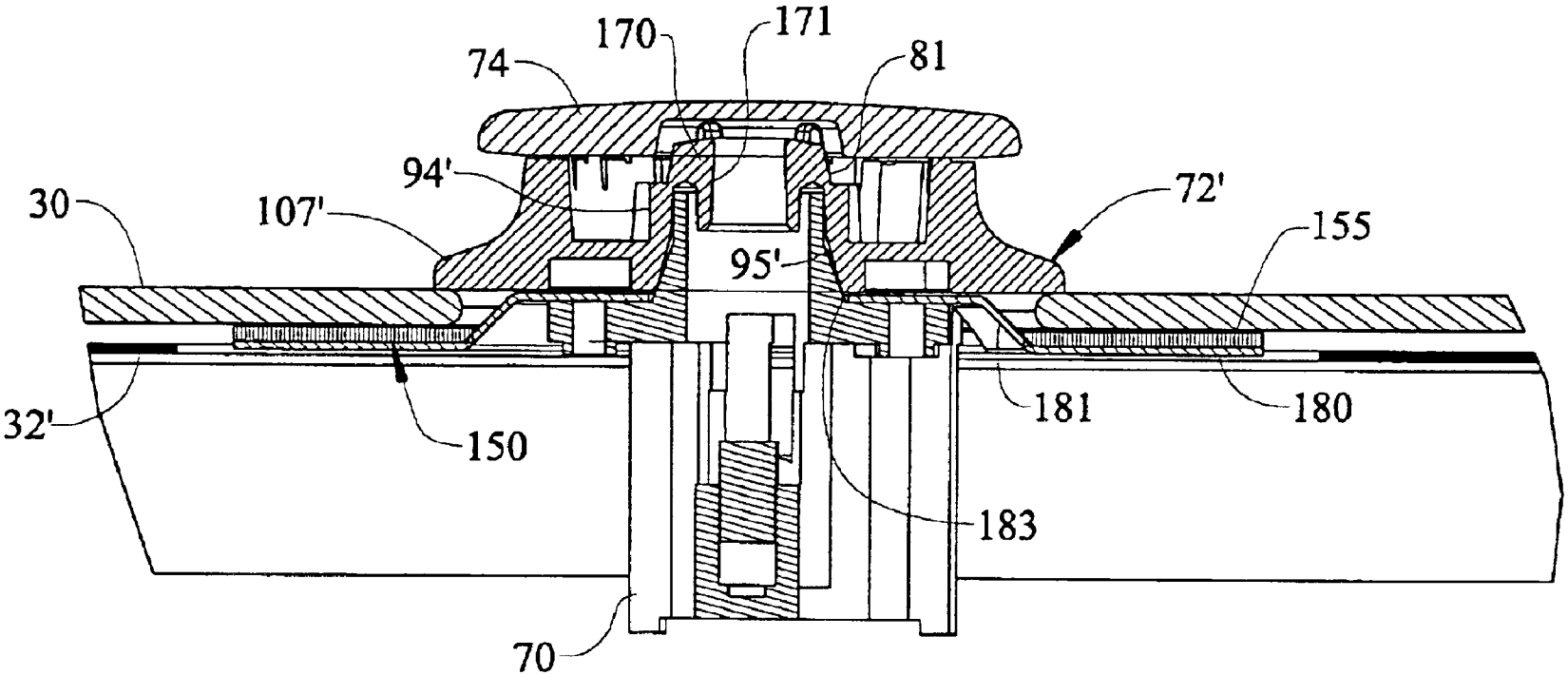
FIG. 5 is a cross-sectional side view of a portion of the gas burner mounting assembly of FIG. 4 shown in an assembled condition.

Referring to FIGS. 4 and 5 illustrating another preferred embodiment of the present invention wherein like reference numerals refer to corresponding parts to the embodiment described above, a gas burner assembly 34' includes a burner base 72', a burner plate 150, a gasket 155 and gas orifice holder 70. In a manner similar to that described above, burner base 72' includes a frusto-conical receiver 94' having a lower or tapered section 95' adapted to engage with tapered portion 80 of frusto-conical projection 78. However, in accordance with the present embodiment, frusto-conical receiver 94' includes a central, downwardly extending sleeve 170 having a central opening 171 that projects into upper annular ring segment 81 of gas orifice holder 70.

In accordance with this preferred form of the present embodiment, gas support frame 32' does not extend to opening 87 in cooktop 30. Therefore, burner plate 150 is provided to serve as a mounting base for gas burner assembly 34'. To this end, burner plate 150 includes a first, substantially planar section 180 extending to an upwardly sloping section 181 that leads to a second planar section 182 terminating in a central opening 183. As shown, second planer section 182 is provided with a pair of opposing mounting apertures 190 and 191 which, as will be discussed more fully below, correspond to openings 103 in burner base 72' and a pair of respective mounting apertures (not separately labeled) arranged within gas orifice holder 70.

In order to secure gas burner assembly 34' to cooktop 30, gas burner assembly 34' also includes a plurality of mechanical fasteners 135 and 136. In accordance with the most preferred form of the invention, mechanical fasteners 135 and 136 extend through openings 103 in burner base 72' through the pair of opposing locating apertures 190 and 191 arranged in second planar section 181 of burner plate 150 and threadably engage the pair of respective mounting apertures (not separately labeled) arranged within gas orifice holder 70. With this arrangement, when burner plate 150 is arranged below opening 87, first planer portion 180 extends along a lower portion of cooktop 30, with upwardly sloping section 181 projecting into opening 87 to locate or center gas orifice holder 70. In addition, second planar section 182 partially supports burner base 72', with cooktop 30 being contacted at an outer periphery of burner base 72'. Actually, first planar portion 180 seats against a lower portion of cooktop 30 through gasket 155. Preferably, gasket 155 serves as a damping or cushioning member for gas burner assembly 34'. More specifically, gasket 155 absorbs a substantial portion of the clamping force applied when gas burner assembly 34' is mounted on cooktop 30. Towards that end, gasket 150 can be formed from a variety of materials such as, for example, fiberglass.

With this arrangement, gasket 155 and burner plate 150 are positioned over gas orifice holder 70 with frusto-conical projection 80 extending through opening 183 in burner plate 150. Gas orifice holder 70 is positioned below cooktop 30 with sloping section 181 centering frusto-conical projection 80 within opening 87 of cooktop 30. At this point, burner base 72' is attached to gas orifice holder 70 such that frusto-conical projection 80 frictionally mates with frusto-conical receiver 94', while downwardly extending sleeve 170 projects into upper annular ring segment 81 of gas orifice holder 70. Once in place, burner base 72' is secured to burner plate 150 and gas orifice holder 70 with fasteners 135 and 136. With this arrangement, gas burner assembly 34' is mounted with cooktop 30 being sandwiched between gas orifice holder 70 and burner base 72', while actually being only indirectly attached to cooktop 30.

Although described with reference to preferred embodiments of the present invention, it should be readily apparent of one of ordinary skill in the art that various changes and/or modifications can be made to the invention without departing from the spirit thereof. For instance, the number and type of mechanical fasteners can be varied without departing from the scope of the present invention. In general, the invention is only intended to be limited to the scope of the following claims.

We claim:

1. A cooking appliance comprising:

a support frame including a top surface, a bottom surface and at least one opening;

a ceramic based panel mounted above the top surface of the support frame, said panel defining a cooktop including at least one opening aligned with the at least one support frame opening;

a gas orifice holder having a first portion arranged below the bottom surface of the support frame and a second portion extending through the at least one support frame opening above the panel, said second portion including a central frusto-conical projection; and a gas burner base including a peripheral edge portion interconnected to a central frusto-conical receiving member through an intermediate section, said frusto-conical receiving member matingly engaging the frusto-conical projection of the gas orifice holder, wherein the gas burner base is centered over the gas orifice holder though the frusto-conical projection to form a gas burner assembly with the gas orifice holder.

2. The cooking appliance according to claim 1, further comprising: first and second locating flanges extending from the support frame into the at least one support frame opening.

3. The cooking appliance according to claim 2, wherein the gas burner base is secured to the gas orifice holder through the first and second locating flanges such that the gas burner assembly is only indirectly attached to the panel.

4. The cooking appliance according to claim 3, further comprising: a plurality of mechanical fasteners extending through the gas burner base and the first and second locating flanges and into the first portion of the gas orifice holder for securing the gas burner base to the gas orifice holder.

5. The cooking appliance according to claim 1, wherein the peripheral edge portion defines a support surface which rests directly upon the panel.

6. The cooking appliance according to claim 1, further comprising: an annular ring projecting upwardly from the gas burner base, said annular ring being provided with a plurality of flame discharge ports.

7. The cooking appliance according to claim 6, further comprising:

a plurality of upstanding projections arranged about the intermediate section, between the frusto-conical receiving member and the annular ring; and a burner cap directly supported by the plurality of upstanding projections above the gas burner base.

8. The rooking appliance according to claim 1, further comprising: a burner plate including a first planar section extending to a upwardly sloping section leading to a second planar section terminating it a central opening, wherein the burner plate is arranged about the gas orifice holder with the second portion of the gas orifice holder extending through the central opening and the upwardly sloping portion centering the gas burner assembly within the at least one opening in the cooktop.

9. The cooling appliance according to claim 8, further comprising: a gasket positioned between the burner plate and the cooktop, said gasket forming a damper to absorb a substantial portion of a clamping force generated between the burner base, the gas orifice holder and the cooktop.

10. The cooking appliance according to claim 9, wherein the gasket is formed from fiberglass.

11. A cooking appliance comprising:

a support frame member including a top surface, a bottom surface and at least one opening;

a ceramic based panel mounted above the top surface of the support frame, said panel defining a cooktop including at least one opening aligned with the at least one support fame opening;

a gas orifice holder having a first portion arranged below the bottom surface of the support frame and a second portion extending through the at least one support frame opening above the panel, said second portion including a central frusto-conical projection; and a gas burner base including a peripheral support surface interconnected to a central frusto-conical receiving member through an intermediate web, said frusto-conical receiving member being adapted to matingly engage the frusto-conical projection extending from the gas orifice bolder to form a gas burner assembly, wherein the peripheral support surface is in direct contact with the panel.

12. The cooking appliance according to claim 11, further comprising: first and second locating flanges extending from the support frame into the at least one support frame opening.

13. The cooking appliance according to claim 12, wherein the gas burner base is secured to the gas orifice holder through the first and second locating flanges such that the gas burner assembly is only indirectly attached to the ceramic-glass panel.

14. The cooking appliance according to claim 13, further comprising: a plurality of mechanical fasteners extending through the gas burner base and the first and second locating flanges and into the first portion of the gas orifice holder for securing the gas burner base to the gas orifice holder.

15. The cooking appliance according to claim 11, further comprising: an annular ring projecting upwardly from the gas burner base, said annular ring being provided with a plurality of flame discharge ports.

16. The cooking appliance according to claim 15, further comprising:

a plurality of upstanding projections arranged about the intermediate section, between the frusto-conical receiving member and the annular ring, and a burner cap directly supported by the plurality of upstanding projections above the gas burner base.

17. The cooking appliance according to claim 11, further comprising: a burner plate including a first planar section extending to a upwardly sloping section leading to a second planar section terminating in a central opening, wherein the burner plate is arranged about the gas orifice holder with the second portion of the gas orifice holder extending through the central opening and the upwardly sloping portion centering the gas burner assembly within the at least one opening in the cooktop.

18. The cooking appliance according to claim 17, further comprising: a gasket positioned between the burner plate and the cooktop, said gasket forming a damper to absorb a substantial portion of a clamping force generated between the burner base, the gas orifice holder and the cooktop.

19. The cooking appliance according to claim 18, wherein the gasket is formed from fiberglass.

* * * * *